US006298209B1

(12) United States Patent
Kelly et al.

(10) Patent No.: US 6,298,209 B1
(45) Date of Patent: Oct. 2, 2001

(54) ELECTROSTATIC POWDER COATED WIRE FOR HYBRID SCAVENGELESS DEVELOPMENT APPLICATIONS

(75) Inventors: Bernard A. Kelly, Ontario; Scott M. Silence, Fairport; Merrilee A. Galloway, Macedon, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/606,667

(22) Filed: Jun. 30, 2000

(51) Int. Cl.[7] ..... G03G 15/08
(52) U.S. Cl. ..... 399/266; 399/291
(58) Field of Search ..... 399/290, 291, 399/266, 98, 99

(56) References Cited

U.S. PATENT DOCUMENTS

| | | | | |
|---|---|---|---|---|
| 4,088,809 | | 5/1978 | Elbling et al. . | |
| 4,233,387 | | 11/1980 | Mammino et al. . | |
| 4,868,600 | | 9/1989 | Hays et al. . | |
| 4,937,166 | | 6/1990 | Creatura et al. . | |
| 5,124,749 | * | 6/1992 | Bares | 399/266 |
| 5,220,384 | * | 6/1993 | Landa et al. . | |
| 5,504,563 | * | 4/1996 | Hays . | |
| 5,600,416 | | 2/1997 | Hart . | |
| 5,666,619 | | 9/1997 | Hart et al. . | |
| 5,761,587 | * | 6/1998 | Laing et al. | 399/291 X |
| 5,778,290 | * | 7/1998 | Badesha et al. | 399/266 |
| 5,787,329 | * | 7/1998 | Laing et al. | 399/266 |
| 5,848,327 | * | 12/1998 | Badesha et al. | 399/99 |
| 5,999,781 | * | 12/1999 | Gervasi et al. | 399/266 |
| 6,049,686 | | 4/2000 | Folkins et al. . | |

* cited by examiner

*Primary Examiner*—Susan S. Y. Lee
(74) *Attorney, Agent, or Firm*—Oliff & Berridge, PLC; Eugene O. Palazzo

(57) ABSTRACT

An electrode wire for a hybrid scavengeless developer unit is electrostatically coated with a conductive coating comprised of a crosslinked polymer and a conductive material. The wire is coated by first electrostatically coating the wire with a coating composition including a crosslinkable polymer and a conductive material. Following electrostatic application of the coating, the coated wire is initially heated to a temperature above the melt temperature of the crosslinkable polymer and below the crosslinking temperature of the polymer for a time sufficient to permit the at least one polymer to flow out over the surface of the wire, and then further heated by increasing the temperature of heating above the crosslinking temperature of the polymer for a time sufficient to crosslink the polymer. A tough, substantially smooth coated electrode wire is achieved that, when used in a hybrid scavengeless developer unit, exhibits little to no buildup of toner or toner components on the surface of the wire, thereby eliminating image quality defects that might otherwise be caused by such buildup.

20 Claims, 5 Drawing Sheets

ELECTROSTATIC POWDER COATED WIRE FOR HYBRID SCAVENGELESS DEVELOPMENT APPLICATIONS

BACKGROUND OF THE INVENTION

1. Field of Invention

This invention relates generally to a wire coated with a coating applied electrostatically and a process for producing such coated wire. The coated wire finds particular application in a hybrid scavengeless development (HSD) apparatus for ionographic or electrophotographic imaging and printing apparatuses and machines. Use of the coated wire in an HSD developer unit assists in preventing toner or other particulate contamination of the wires in such an HSD developer unit.

2. Description of Related Art

Generally, the process of electrophotographic printing includes charging a photoconductive member to a substantially uniform potential to sensitize the surface thereof. The charged portion of the photoconductive surface is exposed to a light image from either a scanning laser beam, an LED source, or an original document being reproduced. This records an electrostatic latent image on the photoconductive surface, the latent image conforming to the original image. After the electrostatic latent image is recorded on the photoconductive surface, the latent image is developed by contacting it with an electrostatically attractable powder known as "toner." Thus, a toner image is produced in conformity with a light image of the original being reproduced. The toner powder image is subsequently transferred to a substrate, e.g., paper. Finally, the toner powder image is heated to permanently fuse it to the substrate in image configuration.

In the process of electrophotographic printing, the step of conveying toner to the latent image on the photoreceptor is known as development. The object of effective development of a latent image on the photoreceptor is to convey toner particles to the latent image at a controlled rate so that the toner particles effectively adhere electrostatically to the charged areas on the latent image. A commonly used technique for development is the use of a two-component developer material, which comprises, in addition to the toner particles which are intended to adhere to the photoreceptor, a quantity of magnetic carrier beads. The toner particles adhere triboelectrically to the relatively large carrier beads, which are typically made of steel. When the developer material is placed in a magnetic field, the carrier beads with the toner particles thereon form what is known as a magnetic brush, wherein the carrier beads form relatively long chains that resemble the fibers of a brush. This magnetic brush is typically created by means of a "transport" roll. The transport roll is typically in the form of a cylindrical sleeve rotating around a fixed assembly of permanent magnets. The carrier beads form chains extending from the surface of the transport roll, and the toner particles are electrostatically attracted to the chains of carrier beads. When the magnetic brush is introduced into a development zone adjacent the electrostatic latent image on a photoreceptor, the electrostatic charge on the photoreceptor will cause the toner particles to be pulled off the carrier beads and onto the photoreceptor.

Another known development technique involves a single-component developer, that is, a developer that consists entirely of toner. In a common type of single-component system, each toner particle has both an electrostatic charge (to enable the particles to adhere to the photoreceptor) and magnetic properties (to allow the particles to be magnetically conveyed to the photoreceptor). Instead of using magnetic carrier beads to form a magnetic brush, the magnetized toner particles are caused to adhere directly to a transport roll. In the development zone adjacent the electrostatic latent image on a photoreceptor, the electrostatic charge on the photoreceptor will cause the toner particles to be pulled from the developer to the photoreceptor. (As used in the claims herein, the phrase "developer material" shall be construed to mean either single-component or two-component developer material, or a portion thereof, such as the toner separated from the two-component developer material on a magnetic brush.)

The electrophotographic marking processes given above can be modified to produce color images. One color electrophotographic marking process, called image-on-image (IOI) processing, superimposes toner powder images of different color toners onto the photoreceptor prior to the transfer of the composite toner powder image onto the substrate. While the IOI process provides certain benefits, such as a compact architecture, there are several challenges to its successful implementation. For instance, the viability of printing system concepts such as IOI processing requires development systems that do not interact with a previously toned image. Since several known development systems, such as conventional magnetic brush development and jumping single-component development, interact with the image on the receiver, a previously toned image will be scavenged by subsequent development if interacting development systems are used. Thus, for the IOI process, there is a need for scavengeless, or noninteractive, development systems.

In a scavengeless development system, toner is made available to the photoreceptor by means of AC electric fields supplied by electrode structures, commonly in the form of wires extending across the photoreceptor, positioned within the nip between a donor roll and photoreceptor. The spacing between the wires and the donor roll is on the order of the thickness of the toner or less, and under certain operating conditions, the wires may be in contact with the donor roll.

A typical hybrid scavengeless development apparatus includes, within a developer housing, a transport roll, a donor roll, and an electrode structure. The transport roll operates in a manner similar to a development roll in a conventional development system, but instead of conveying toner directly to the photoreceptor, conveys toner to a donor roll disposed between the transport roll and the photoreceptor. The transport roll is electrically biased relative to the donor roll, so that the toner particles are attracted from the transport roll to the donor roll. The donor roll further conveys toner particles from the transport roll toward the photoreceptor. This donor roll generally consists of a conductive core covered with a thin (50–200 $\mu$m) partially conductive layer. In the nip between the donor roll and the photoreceptor are the wires forming the electrode structure. During development of the latent image on the photoreceptor, the electrode wires are AC-biased relative to the donor roll to detach toner therefrom so as to form a toner powder cloud in the gap between the donor roll and the photoreceptor. Typical ac voltages of the wires relative to the donor roll are 700–900 Vpp at frequencies of 5–15 kHz. These AC signals are often square waves, rather than pure sinusoidal waves. The latent image on the photoreceptor attracts toner particles from the powder cloud, forming a toner powder image thereon.

A problem with developer systems using wires is that toner and/or toner constituents buildup on the wires over time and result in development defects. Wire contamination is a first class of defect in which toner and/or toner constituents buildup on the wire side that is in contact with the donor roll. Wire history is a second class of defect in which toner and/or toner constituents buildup on the wire side away from the donor roll. Constant cleaning of the wires is required in order to alleviate the above-defects, which cleaning is time-consuming and inefficient in that it requires machine downtime.

U.S. Pat. No. 6,049,686 sought to address the above-identified problems, the patent describing a hybrid scavengeless development apparatus and a method for preventing wire contamination. As in the standard hybrid scavengeless development method discussed above, a voltage supply is provided for electrically biasing the electrode wires during a developing operation with an alternating current (AC) bias to detach marking particles from the donor member, forming a cloud of marking particles in the development zone, and developing the latent image with marking particles from the cloud. In the process of this patent, however, the voltage supply periodically electrically biases the electrode wires during a cleaning operation with a direct current (DC) bias and with an alternating current bias so that toner is effectively removed from the wire. The bias levels are chosen to reduce field-induced redeposition of right or wrong sign toner.

What is desired is a more efficient and effective method of preventing toner constituent build-up on the wires in the first instance, thereby substantially reducing or eliminating the frequency of needed cleaning operations of the wires, and also substantially reducing or eliminating image quality defects that might otherwise be caused by such buildup.

SUMMARY OF THE INVENTION

It is therefore an object of the present invention to develop a wire for use as an electrode wire in a hybrid scavengeless developer unit, which wire exhibits little or no buildup of toner constituents on the surface thereof during operation.

These and other objects are achieved by the present invention pertaining to an electrode wire for a hybrid scavengeless developer unit. The electrode wire is electrostatically coated with a conductive coating comprised of a crosslinked polymer and a conductive material and optionally additional materials to adjust the triboelectric charging properties of the wire against the toner and hardness of the coating.

These and other objects are also achieved by a novel method of making such coated wire. In the method, the wire is coated by first electrostatically coating the wire with a coating composition including a crosslinkable polymer and a conductive material. Following electrostatic application of the coating, the coated wire is initially heated to a temperature above the melt temperature of the crosslinkable polymer but below the crosslinking temperature of the polymer for a time sufficient to permit the at least one polymer to flow out over the surface of the wire, and then further heated by increasing the temperature of heating above the crosslinking temperature of the polymer for a time sufficient to crosslink the polymer.

These and other objects of the present invention are also achieved in that the coated wire has a tough, substantially smooth coating that, when used in a hybrid scavengeless developer unit, exhibits little to no buildup of toner or toner constituents on the surface of the wire, thereby eliminating image quality defects that might otherwise be caused by such buildup.

The invention thus also relates to a developer unit, and printing machine containing such developer unit, for developing a latent image recorded on an image receiving member with developer material to form a developed image, comprising a donor member, spaced from the image receiving member, for transporting the developer material to a development zone adjacent the image receiving member, at least one electrode wire positioned in the development zone between the image receiving member and the donor member, and a voltage supply for electrically biasing the at least one electrode to detach the developer material from the donor member to form a cloud of developer material in the development zone, wherein the at least one electrode wire has a conductive coating comprised of a crosslinked polymer and a conductive material.

DETAILED DESCRIPTION OF PREFERRED EMBODIMENTS

Figure 1:
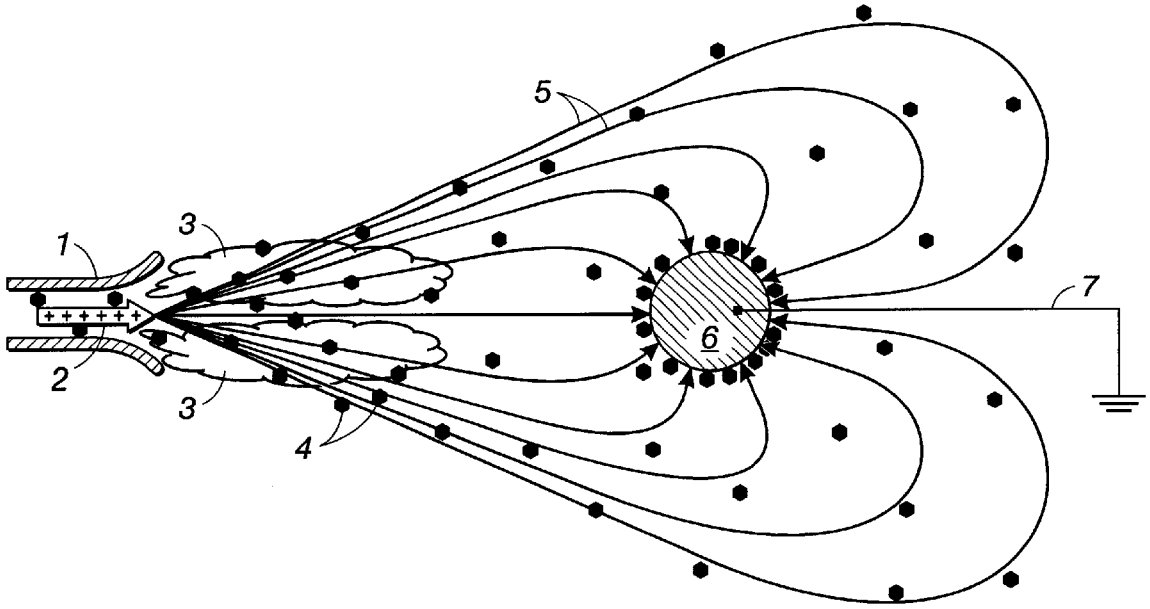
FIG. 1 illustrates electrostatic application of the coating to a wire surface with an electrostatic spray gun.

As discussed above, a typical hybrid scavengeless developer unit includes, within a developer housing, a transport member (typically a roll), a donor member (also typically a roll), and an electrode structure. The transport roll conveys toner to the donor roll disposed between the transport roll and the photoreceptor. The transport roll is electrically biased relative to the donor roll, so that the toner particles are attracted from the transport roll to the donor roll. The donor roll further conveys toner particles from the transport roll toward the photoreceptor. The donor roll generally consists of a conductive core covered with a thin (50–200 $\mu$m) partially conductive layer. Mounted in the nip between the donor roll and the photoreceptor are the wires forming the electrode structure. During development of the latent image on the photoreceptor, the electrode wires are AC-biased relative to the donor roll to detach toner therefrom so as to form a toner powder cloud in the gap between the donor roll and the photoreceptor. Typical AC voltages of the wires relative to the donor roll are 700–900 Vpp at frequencies of 5–15 kHz. These AC signals are often square waves, rather than pure sinusoidal waves. The latent image on the photoreceptor attracts toner particles from the powder cloud, forming a toner powder image thereon.

Additional structural details of such hybrid scavengeless developer units and printing machines containing the developer units, as well as details concerning the development of latent images with such developer units, are known and can be found in, for example, U.S. Pat. Nos. 4,868,600, 5,600,416, 5,666,619 and 6,049,686, each incorporated herein by reference in their entireties. It is thus not necessary herein to discuss the known details of the operation of such developer units in developing a latent image upon a photoreceptor.

The wire and coating composition will first be described. The wire itself may be any suitable material capable of carrying an electrical charge (i.e., it is conductive). Most preferably, the wire is stainless steel. For use as an electrode structure in a hybrid scavengeless developer unit, the wire preferably has a small diameter, for example on the order of 0.0001 to 0.1 inches in diameter, preferably 0.0005 to 0.025 inches in diameter.

As discussed above, the use of stainless steel wires as the electrode structure is problematic in that toner and toner constituents tend to build-up on the surface of the wire. Wire contamination is a defect in which the toner and toner constituents buildup on the surface of the wire in contact with the donor roll, while wire history is a defect in which the toner and toner constituents buildup on the surface of the wire away from the donor roll. In developing this invention, the inventors found that the significant properties of the wire in relation to wire contamination were the smoothness and hardness of the wire, and the significant properties of the wire in relation to wire history were the electrostatic charging ability and conductivity of the wire.

It was found that all of these properties could be appropriately controlled and adjusted with a proper coating upon the wire surface so as to achieve a wire substantially resistant to wire history and wire contamination defects.

The coating composition for coating the surface of the wire comprises one or more crosslinkable polymers and one or more conductive materials, optionally also with additional additives such as, for example, electrostatic charge adjusting or surface hardening materials.

The crosslinkable polymers are preferably thermosetting polymers that can provide high toughness coatings upon crosslinking, and are preferably selected from among polyurethanes, acrylics and epoxies. Preferred are polyurethane polymers, for example Envirocron available from PPG Industries Inc. (Product number PCU0101). This polymer has a melt temperature of between about 210° F. and about 266° F., and a crosslinking temperature of about 345° F.

Any suitable conductive material may be added to the polymers in order to impart conductivity thereto. Suitable examples include, for example, carbon black, metals such as iron, copper, aluminum, etc., salts of alkali or alkaline earth metals with iodine or bromine, and salts of cadmium, zinc or transition metals with a halogen. Most preferably, carbon black, for example Conductex SC Ultra Carbon Black from Columbian Chemical Co., is used as the conductive material. The conductive materials are preferably in the form of small sized particles, for example on the order of 1 micrometers or less, preferably on the order of 100 nanometers or less.

The conductive material is added to the crosslinkable polymer in amounts sufficient to achieve a coated wire with appropriate conductivity. This amount varies depending on the conductive material being used. Preferably, the coating contains an amount of conductive material to achieve a conductivity in the range of from, for example, $1\times10^{-8}$ to $1\times10^{-1}$ Siemans per centimeter, most preferably from $1\times10^{-5}$ to $1\times10^{-2}$ Siemans per centimeter. Typically, the conductive material will be added to the coating composition in an amount of from 5 to 95% by weight. For example, when carbon black is used as the conductive material, it is preferably added in an amount of from, for example, about 5 to about 70% by weight of the coating composition, most preferably about 10 to about 30% by weight of the coating composition.

In addition, the coating composition may also contain materials for adjusting the electrostatic charging properties of the coating. Suitable materials in this regard include, for example, organic and inorganic salts such as quaternary ammonium salts. Also, polymers different from the main crosslinkable polymer may be used to adjust the electrostatic charging properties of the main crosslinkable polymer. For example, an additional polymer such as polymethylmethacrylate, polyvinylidinefluoride, polytrifluoroethylmethacrylate, other acrylic resins, or thermosetting polymers containing halogens such as bromine, fluorine or chlorine may be used. Further, particles of crosslinked (i.e., non-melting) polymers may also be used, for example crosslinked acrylic resins such as Epostar particles (Type S) obtained from Nippon Shokubai Co., Ltd.

Adjustment of the triboelectric charging properties of the wire relative to the toner particles is necessary to minimize, most preferably entirely avoid, transfer of charge between to toner particles and the surface of the wire as the toner particles repeatedly contact the surface of the wire. With respect to wire contamination, this is relevant for the surface of the wire facing the donor roll, that is continuously in contact and triboelectrically, or frictionally, charging the toner which resides on the donor roll, that is, the fraction of the toner which is not released from the donor roll to form the powder cloud. This is similar to blade charging of toner in single component development systems, which are well known in the art. With respect to wire history, this is relevant for the surface of the wire facing away from the donor roll that is periodically in contact and triboelectrically, or frictionally, charging the toner which resides in the powder cloud. In either case, the transfer of charge causes electrostatic adhesion that binds the toner to the wire and contributes to either wire history or contamination.

The adjustment of the triboelectric charging properties by the addition of a polymer to the wire coating not in close proximity in the triboelectric series is conceptually similar to the addition of a second polymer of the same type to a carrier coating in the powder coating process as disclosed in U.S. Pat. No. 4,937,166, incorporated herein by reference in its entirety. In the present invention, the utility is to adjust the triboelectric charging of the toner to a value of zero.

Measurement of the triboelectric value of the wire after coating is difficult; in practice the triboelectric value of the wire coating can be determined by placing the coating on either a plate by well known electrostatic spray methods or on carrier core by the well known carrier powder coating process as disclosed in U.S. Pat. No. 4,233,387, incorporated herein by reference in its entirety, and contacting toner to either of those surfaces and measuring the triboelectric charging value by standard cascade development or Faraday cage blow-off methods. The preferred range of the absolute value of the triboelectric charge imparted to the toner is less than 10 microcoulombs per gram of toner, preferably less than 5 microcoulombs per gram, most preferably less than 1 microcoulomb per gram.

If present, the material for adjusting the electrostatic charging property is preferably added in an amount of from about 0 to about 50% by weight of the coating composition.

Additional materials may also be added to the coating composition if desired. Such additional materials may include, for example, crosslink accelerators, flow control agents, hardeners, etc.

The method of coating the wire with the coating composition will next be described. The method comprises (1) melt-mixing components of the above-described coating composition, (2) grinding the resultant melt-mixed components to particles having a volume average particle size of from about 1 micrometer to about 100 micrometers, (3) electrostatically coating the particles onto the surface of the wire, (4) initially heating the coated wire to a temperature above the melt temperature of the crosslinkable polymer of the coating composition but below the crosslinking temperature of the crosslinkable polymer for a time sufficient to permit the polymer to flow out over the surface of the wire, and (5) following the initial heating, additionally heating the coated wire to a temperature above the crosslinking temperature of the polymer for a time sufficient to crosslink the polymer.

The coating composition components are first mixed together under hot melt conditions. The mixing is carried out at temperatures above the melting point of the crosslinkable polymer in the coating composition, but well below the crosslinking temperature of such polymer. For example, the temperature may be from 100° F. to 290° F. The time of the hot-melt mixing should be sufficient for the components of the coating composition to become well mixed, e.g., homogeneous. This may be from, for example, 30 seconds to 1 hour or more, typically less than 15 minutes.

The melt-mixing may be carried out in a suitable apparatus such as, for example, a two-roll mill, a blade mixer, a Banbury mixer, or an extruder such as a kneader or a twin screw extruder. Most preferably, an extruder is used as extruders are able to rapidly achieve a uniform mixture.

Following melt mixing, the resultant melt-mixed materials, i.e., the extrudate from an extruder, is then ground into small sized particles suitable for electrostatic application to the surface of the wire. Grinding may be accomplished with, for example, a microcrusher or pulverizer. The grinding should continue until the volume average particle size of the particles falls within the range of from about 1 to about 100 micrometers, preferably from about 3 to about 25 micrometers, most preferably about 5 micrometers or less. This size range is typically necessary in order for the particles to retain sufficient charge to be electrostatically coated as well as have a sufficient size to coat and adhere to the surface of the wire.

If a second polymer added to adjust the triboelectric value of the wire has a particle size of 5 microns or less and has a rhelogical temperature profile similar to that of the crosslinking polymer, this polymer can optionally be combined with the ground polymer composition above by physical mixing of the powders prior to eletrostatic coating onto the wire. This is not the preferred embodiment, due to the segregation of powders which can occur during the electrostatic coating process and the subsequent non-uniformity of the wire coating on a macroscopic scale, that is, over length scales of millimeters or greater.

Once ground, the particles are then electrostatically coated onto the surface of the wire. Any suitable technique to effect electrostatic coating may be used, including, for example, coating with an electrostatic gun or in an electrostatic fluidized bed. See, for example, U.S. Pat. No. 4,088,809, incorporated herein by reference in its entirety. In a preferred embodiment, an electrostatic spray gun is used to apply a thin film of the particles to the surface of the wire. Commercially available spray guns such as the Nordson Model Versa Spray HRM-3 or Voltastatic Solid Spray 90 System may be used.

FIG. 1 illustrates such an electrostatic spray gun suitable for use herein. In FIG. 1, 1 is the spray gun nozzle, 2 is the spray gun electrode, 3 is an air stream, 4 is the coating powder particles, 5 represents the electric field, and 7 is the ground. The wire 6 is shown in cross-section. As can be seen, due to the nature of electric fields, the field lines encompass the entire grounded wire. The coating particles are forced into the electric field by the air stream, where they become charged and then follow the field lines to the wire surface. The charged particles electrostatically adhere to the surface of the wire.

Operation of an electrostatic spray gun is conventional, and thus practitioners in the art can select appropriate voltages, fluidized bed air pressure and powder flow air pressure, and time of coating to achieve a uniform coating of the particles to a desired thickness upon the surface of the wire. Generally, the coating powder to be coated is contained in a hopper with an agitating medium therein, such as a fluidizer, thereby preventing powder compacting. Thereafter, air pressure can be selected for the purpose of delivering the powder to an electrostatic gun with, for example, an Venturi tube or connecting plastic tube. Further, the electrostatic gun typically has one or more built in electrodes which are raised to a high voltage, for example 30 or 80 kilovolts, thereby enabling the surrounding air to be ionized and formulating a current of at least several microamps of ions of a single polarity. Ionization of the air is important in that insulating powder will not charge effectively simply by contacting with a high voltage. Thereafter, the charged, powdered polymer particles travel towards the grounded substrate directed by the air selected to disperse the polymer powder, and the electric force of the charged particles caused by the electric field between the high voltage gun and the substrate. Illustrative conditions for operation of the electrostatic spray gun are further noted below in the examples.

The electrostatic coating may be carried out in either a batch or continuous process. In a preferred embodiment, the wire is set to slowly move through an electrostatic coating zone in which the wire to be coated moves past the electrostatic coating applicator at a rate sufficient to deposit a coating of the desired thickness. If desired in either the batch or continuous process, the wire may be rotated during coating to ensure an even coating over the surface of the wire. Moreover, during the spraying process, the gun selected may be traversed horizontally or vertically past the wire. Movement of the gun can be achieved manually or, for example, by use of an automatic reciprocator.

The coating is continued for a sufficient period of time so as to provide a layer of the coating powder in the desired thickness. This thickness may range from, for example, 1 micrometer to 100 micrometers, i.e., the thickness corresponding to the diameter range of the particles of the coating. More preferably, the coating has a thickness of from, for example, about 2 micrometers to about 10 micrometers.

Once the coating composition is coated onto the surface of the wire to the desired thickness, the coated wire is then subjected to an initial heating step wherein the polymer of the coating is melted but not crosslinked, thereby permitting the polymer of the coating to flow out into a uniform coating upon the surface of the wire. To accomplish this, the initial heating is preferably conducted at a temperature above the melting temperature of the crosslinkable polymer of the coating, but below the crosslinking temperature of the polymer. For example, the initial heating may be conducted at a temperature of from about 100° F. to about 290° F. for a time of about 1 minute to about 1 hour. The initial heating preferably is conducted to accomplish flow out of the polymer over the surface of the wire, without any substantial loss of thickness of the coating, and most preferably to achieve a substantially smooth coating of the coating material upon the surface of the wire.

By a "substantially smooth" coating herein is intended a coating upon the surface of the wire that is substantially uniform in thickness, that does not show any bare wire, and that is substantially free of surface irregularities. Surface irregularities can be quantified by inspection of the coated wire by scanning electron microscopy (SEM) or transmission electron microscopy (TEM). Measurement of the thickest portion of the coating (coating peak) and thinnest portion of the coating (coating valley) can be made over a linear portion of the wire in the field of view of the photomicrograph. When a linear portion of approximately 100 microns is within the field-of-view of the photomicrograph, the peak-to-valley variation should be no more than 1 to 2 microns. When a linear portion of 10 microns or less is within the field-of-view of the photomicrograph, the peak-to-valley variation should be no more than 40 to 200 nanometers. This former smoothness requirement is necessary to keep uniform electrostatic development potential and forces along the length of the wire, and the latter surface smoothness scale is believed to be critical to eliminate wire contamination, as surface roughness on the length scale of 40 to 200 nanometers is comparable to the dimension of the external additives on the toner surface and can act to trap the additives to begin the process of wire contamination.

The step of initially heating the coated wire to a temperature below the crosslinking temperature of the crosslinkable polymer of the coating is important in achieving the objects of the present invention. If crosslinking is achieved in one heating step, for example as in U.S. Pat. No. 4,088,809, a non-uniform coating having many coating defects is obtained, i.e., the coating is not substantially smooth. By undertaking heating in two separate steps, the first to melt the polymer and permit flow out and the second to effect crosslinking, a more uniform and substantially smooth coating is achieved. As discussed above, surface smoothness is a significant factor in the wire being able to avoid the defect of wire contamination, and thus the method of the present invention achieves a coated wire having a smoothness capable of substantially avoiding or eliminating wire history.

Following the initial heating, an additional heating step is conducted in which the coated wire is heated to a temperature above the crosslinking temperature of the polymer of the coating composition, thereby effecting crosslinking and curing of the coating. Typically, the second heating step is to a temperature of from about 300° F. to about 800° F. for a time of about 1 minute to about 1 hour. The higher the temperature, the shorter the time required to complete crosslinking of the polymer.

Once crosslinked, the wire is coated with a substantially smooth coating that has a high hardness as a result of the crosslinking of the polymer. The coating will preferably have a hardness of from, for example, H to 6H, preferably 2H to 6H, as measured using ASTM Standard Test D3363-92 (Standard Test Method for Film Hardness by Pencil Method). As the coated wire is substantially smooth with a high hardness, it is capable of avoiding the defect of wire contamination.

Moreover, through selection of the proper coating composition materials as discussed above, the coated wire also possesses suitable electrostatic charging ability and conductivity properties to effectively combat or eliminate the defect of wire history. The coated wire preferably has an electrostatic charging ability of from, for example 0 to an absolute value of less than 5 microcoulombs per gram, most preferably less than 1 microcoulomb per gram, as measured by placing the coating on a carrier core and practicing the standard Faraday cage blow-off technique, and a surface conductivity through the coating of from, for example, $1\times10^{-5}$ to $1\times10^{-2}$ Siemans per centimeter.

The coated wires are thus suitably used as the electrode structure in a hybrid scavengeless developer unit in that the coated wires are able to substantially reduce or eliminate the defects of toner or toner constituents building up on the surface of the wire during operation, and thereby substantially reduce or eliminate both the need for frequent wire cleaning operations and image quality defects caused by buildup upon the wire surface.

The invention will now be further described by way of the following examples.

Example 1

Figure 2:
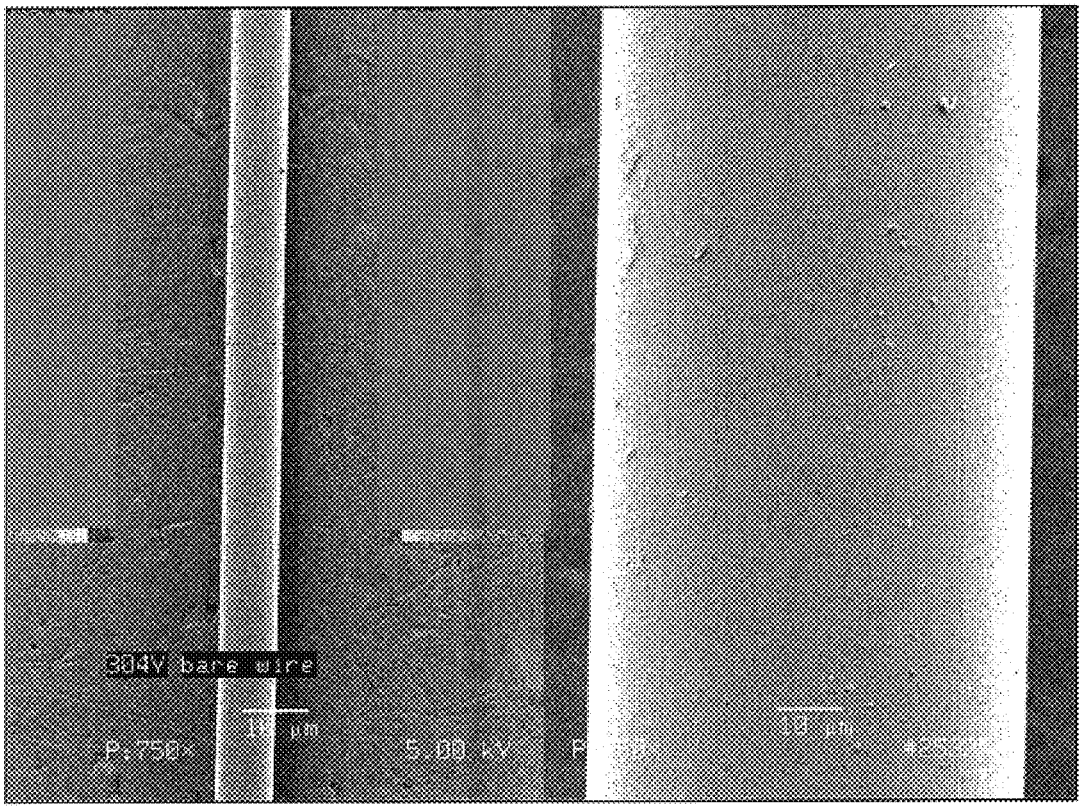
FIG. 2 is a scanning electron micrograph (SEM) of a bare stainless steel wire.

In this example and comparative examples, the coating composition is comprised of 80% by weight of Envirocron, a polyurethane from PPG Industries Inc., and 20% by weight of Conductex SC Ultra Carbon Black, a carbon black from Columbian Chemical Co. The coating composition is obtained by melt-mixing the components in an extruder and then grinding the extrudate in a fluidized bed grinder to a volume average particle size of about 5 micrometers. In this example and comparative example, a type 304 stainless steel wire having a diameter of 0.0025 inches is used. The bare uncoated stainless steel wire is shown in the SEM photograph of FIG. 2.

To coat the wire, the wire is clamped to each side of a steel fixture having a width of 26 inches. The tray is grounded at a common earth ground, thereby also grounding the wire. The coating powder is placed inside of the fluidized bed of the electrostatic powder paint system, a Nordson Model Versa Spray HRM-3. The electrostatic spray gun is then used to coat the wire under the following conditions:

voltage—approximately 41,000 to 43,000 volts at 15 to 20 microamps;

fluidized bed air pressure—49 to 51 psi;

powder flow air pressure—39 to 41 psi.

The powder is applied manually using the electrostatic spray gun. Thickness was determined by sight, a thicker coating being applied by continuing application until a solid black coating is seen, and a lighter coating being applied by continuing coating until a gray coating is seen.

Figure 3:
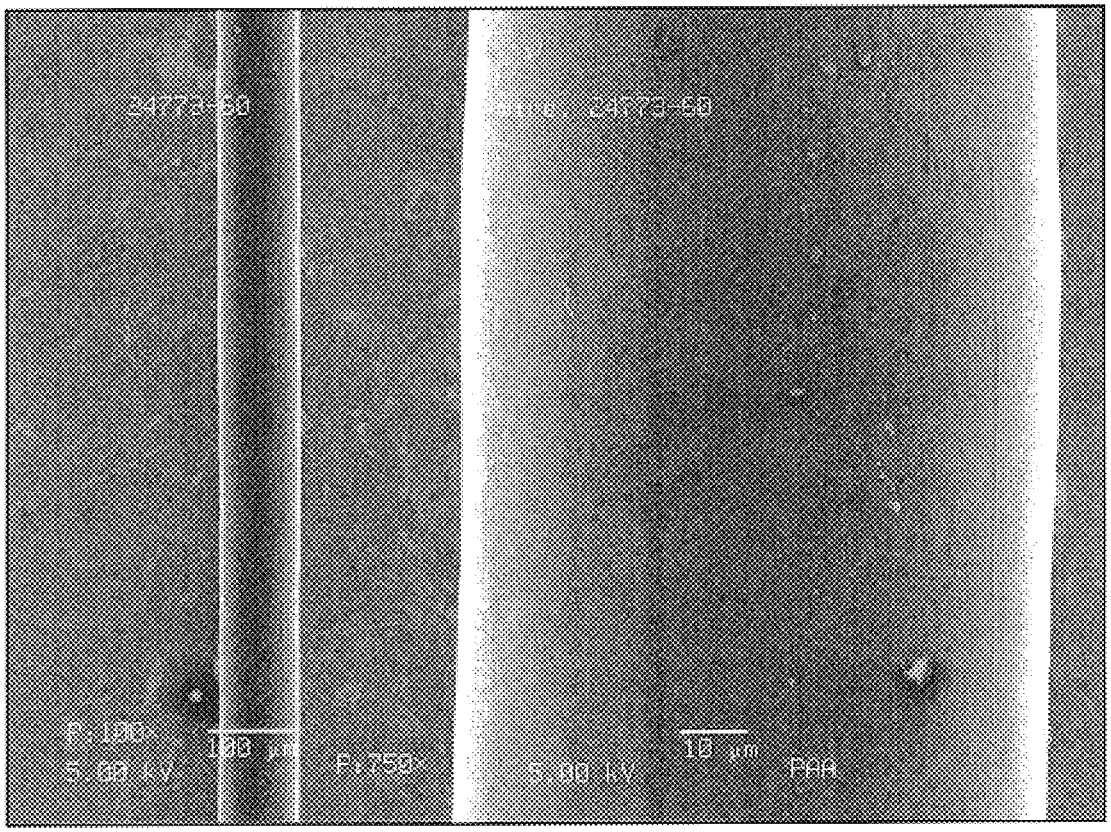
FIGS. 3–5 are SEMs of wires coated with a conductive crosslinked coating.

In Example 1, a coating thickness of about 11 microns is applied. The coating is first heated in a preheated oven at 250° F. for about 60 minutes, and then the oven temperature is increased to 350° F. and the coating permitted to cure for 45 minutes. An SEM photograph of the resultant wire is shown in FIG. 3.

Figure 4:
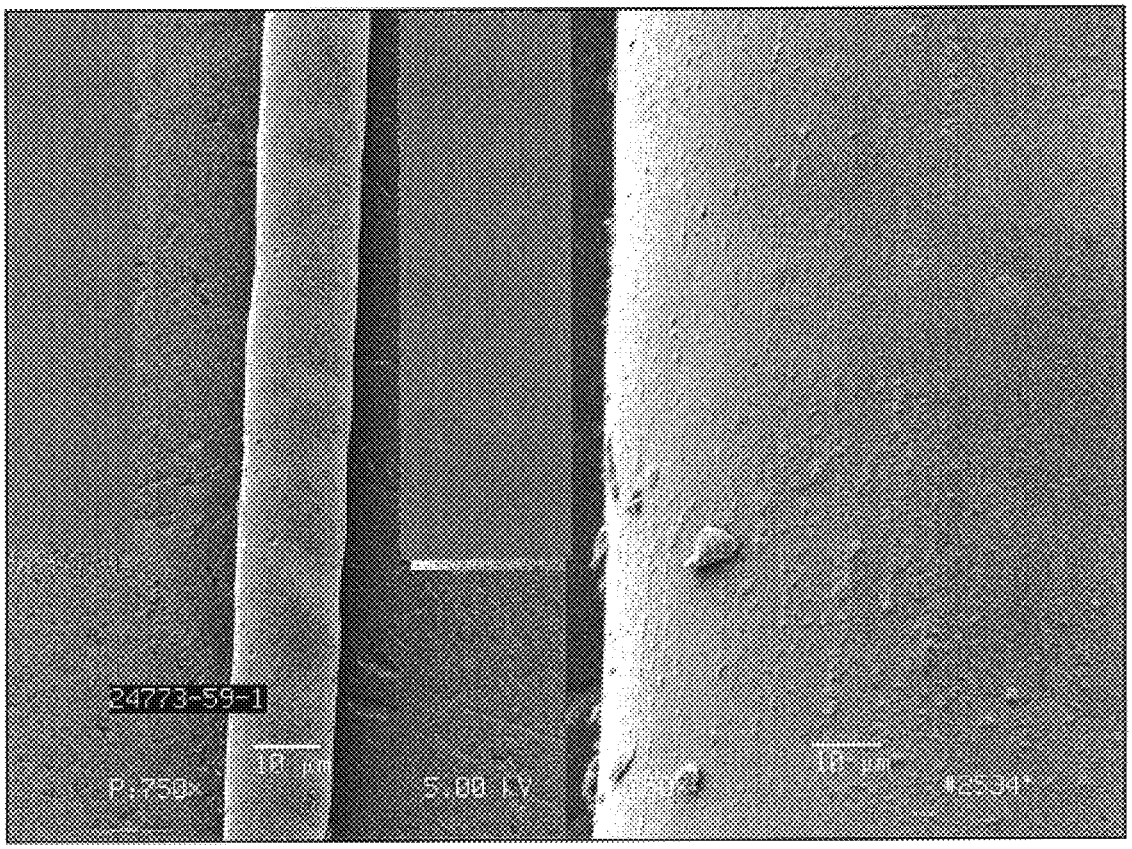

In Comparative Example 1, a coating thickness of about 26 microns is applied. The coating is heated in a preheated oven at 400° F. for about 20 minutes to fuse and crosslink the coating in a single step. An SEM photograph of the resultant wire is shown in FIG. 4.

Figure 5:
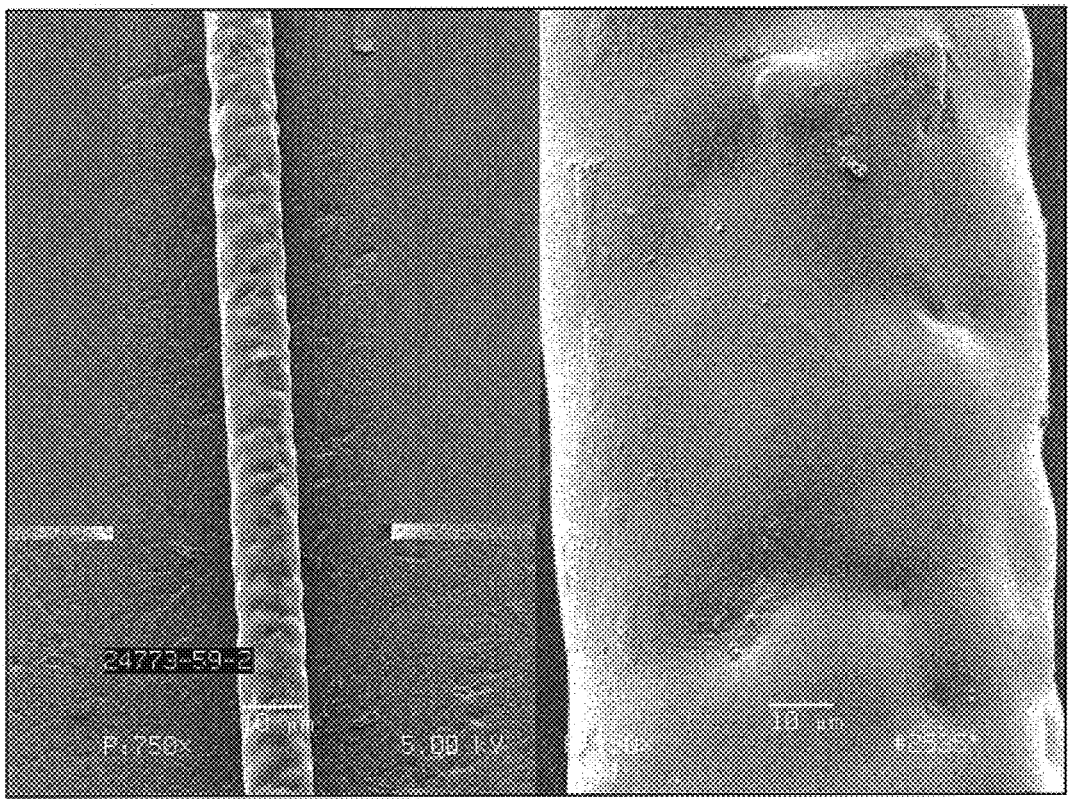

In Comparative Example 2, a coating thickness of about 6 microns is applied. The coating is heated in a preheated oven at 400° F. for about 20 minutes to fuse and crosslink the coating in a single step. An SEM photograph of the resultant wire is shown in FIG. 5.

As can be seen from examination of the SEM photographs, the invention (Example 1, FIG. 3) achieves a coated wire with a substantially smooth surface. The coated wire of Comparative Example 1 (FIG. 4) has more surface irregularities than the coated wire of Example 1, despite having a much greater thickness of coating. Further, the coating of Comparative Example 2 (FIG. 5) has bare wire showing through.

The coated wire of Example 1 satisfies the criteria of smoothness and hardness believed to be necessary to reduce or eliminate wire contamination. Further, the wire coating is electrically conductive, satisfying one of the two criteria believed to be necessary to reduce or eliminate wire history. When the final criteria of a substantially low triboelectric charge of the toner against the wire is met by the addition of a polymer to the wire coating not in close proximity in the triboelectric series, it is believed that the wire will have a minimum to zero level of wire contamination and wire history compared to the coated wires of the comparative examples when used as the electrode in a hybrid scavengeless developer unit.

Example 2

In this example, a second polymer not in close proximity in the triboelectric series is added to the polymer coating used in Example 1 to reduce or eliminate the triboelectric charging of the polymer coating on the wire against the toner used in the hybrid scavengeless developer unit. The second polymer used in Kynar 301F, a polyvinylidene flouride polymer obtained from Elf-Atochem Inc. which has a primary particle size of approximately 0.2 to 0.5 microns. The triboelectric properties of the polymer for coating the wire are characterized by physically mixing the ground Envirocron/carbon black composite and Kynar into a homogeneous mixture, and powder coating that mixture onto a 100 micron volume median diameter spherical steel in the normal rotary kiln powder coating process. A temperature profile ramping up to 400° F. in a period of approximately 20 minutes was used, followed by an additional 10 minutes at a constant temperature of 400° F.

The triboelectric response of this coating is shown in Table 1, as a function of the Kynar content of the coating. The triboelectric value is characterized against a 7.4 micron volume median diameter polyester-based toner which contains a magenta pigment. The triboelectric value of the coating decreases approximately linearly with Kynar content, reaching a value less than 1 microcoulomb per gram at 30% Kynar concentration.

TABLE 1

| % kynar in the coating | Tribo (microcoulombs per gram of toner) |
|---|---|
| 0 | 11.3 |
| 10 | 6.1 |
| 20 | 3.2 |
| 30 | 0.95 |

What is claimed is:

1. A developer unit for developing a latent image recorded on an image receiving member with developer material, to form a developed image, comprising:

a donor member, spaced from the image receiving member, for transporting the developer material to a development zone adjacent the image receiving member;

at least one electrode wire positioned in the development zone between the image receiving member and the donor member; and a voltage supply for electrically biasing the at least one electrode to detach the developer material from the donor member to form a cloud of developer material in the development zone;

wherein the at least one electrode wire has a conductive coating comprised of a crosslinked polymer and a conductive material, and wherein the conductive coating has a hardness of from H to 6H, as defined by ASTM D3363–92.

2. The developer unit according to claim 1, wherein the conductive coating is substantially smooth.

3. The developer unit according to claim 1, wherein the crosslinked polymer is comprised of a crosslinked thermosetting polymer selected from the group consisting of polyurethane, epoxy and acrylic.

4. The developer unit according to claim 1, wherein the conductive coating further contains one or more materials for adjusting the electrostatic charging ability of the conductive coating.

5. The developer unit according to claim 1, wherein the conductive coating has a conductivity of from $1\times10^{-5}$ to $1\times10^{-2}$ Siemans per centimeter.

6. The developer unit according to claim 1, wherein the conductive coating is an electrostatically deposited coating.

7. A printing machine having a developer unit for developing a latent image recorded on an image receiving member with developer material to form a developed image, the developer unit comprising:

a donor member, spaced from the image receiving member, for transporting the developer material to a development zone adjacent the image receiving member;

at least one electrode wire positioned in the development zone between the image receiving member and the donor member; and a voltage supply for electrically biasing the at least one electrode to detach the developer material from the donor member to form a cloud of developer material in the development zone;

wherein the at least one electrode wire has a conductive coating comprised of a crosslinked polymer and a conductive material, and wherein the conductive coating has a hardness of from H to 6H, as defined by ASTM D3363-92.

8. The printing machine according to claim 7, wherein the conductive coating is substantially smooth.

9. The printing machine according to claim 7, wherein the crosslinked polymer is comprised of a crosslinked thermosetting polymer selected from the group consisting of polyurethane, epoxy and acrylic.

10. The printing machine according to claim 7, wherein the conductive coating further contains one or more materials for adjusting the electrostatic charging ability of the conductive coating.

11. The printing machine according to claim 7, wherein the conductive coating has a conductivity of from $1\times10^{-5}$ to $1\times10^{-2}$ Siemans per centimeter.

12. The printing machine according to claim 7, wherein the conductive coating is an electrostatically deposited coating.

13. An electrode wire for a hybrid scavengeless developer unit, the electrode wire comprising a wire coated with a substantially smooth conductive coating comprised of a crosslinked polymer and a conductive material, and wherein the substantially smooth conductive coating has a hardness of from H to 6H, as defined by ASTM D3363-92.

14. The electrode wire according to claim 13, wherein the wire comprises stainless steel.

15. The electrode wire according to claim 13, wherein the crosslinked polymer is comprised of a crosslinked thermosetting polymer selected from the group consisting of polyurethane, epoxy and acrylic.

16. The electrode wire according to claim 13, wherein the conductive coating further contains one or more materials for adjusting the electrostatic charging characteristics of the conductive coating.

17. The electrode wire according to claim 13, wherein the conductive coating has a conductivity of from $1\times10^{-5}$ to $1\times10^{-2}$ Siemans per centimeter.

18. A developer unit for developing a latent image recorded on an image receiving member with developer material, to form a developed image, comprising:

a donor member, spaced from the image receiving member, for transporting the developer material to a development zone adjacent the image receiving member;

at least one electrode wire positioned in the development zone between the image receiving member and the donor member; and a voltage supply for electrically biasing the at least one electrode to detach the developer material from the donor member to form a cloud of developer material in the development zone;

wherein the at least one electrode wire has a conductive coating comprised of a crosslinked polymer and a conductive material, wherein the conductive coating is substantially smooth and has a conductivity of from $1\times10^{-5}$ to $1\times10^{-2}$ Siemans per centimeter.

19. A printing machine having a developer unit for developing a latent image recorded on an image receiving member with developer material to form a developed image, the developer unit comprising:

a donor member, spaced from the image receiving member, for transporting the developer material to a development zone adjacent the image receiving member;

at least one electrode wire positioned in the development zone between the image receiving member and the donor member; and a voltage supply for electrically biasing the at least one electrode to detach the developer material from the donor member to form a cloud of developer material in the development zone;

wherein the at least one electrode wire has a conductive coating comprised of a crosslinked polymer and a conductive material, wherein the conductive coating is substantially smooth and has a conductivity of from $1\times10^{-5}$ to $1\times10^{-2}$ Siemans per centimeter.

20. An electrode wire for a hybrid scavengeless developer unit, the electrode wire comprising a wire coated with a substantially smooth conductive coating comprised of a crosslinked polymer and a conductive material, and wherein the conductive coating has a conductivity of from $1\times10^{-5}$ to $1\times10^{-2}$ Siemans per centimeter.

* * * * *